United States Patent [19]

Langhoff et al.

[11] Patent Number: 4,715,809

[45] Date of Patent: Dec. 29, 1987

[54] FLUIDIZED BED HAVING MODIFIED SURFACES IN THE HEAT EXTRACTOR

[75] Inventors: Josef Langhoff, Dinslaken; Hermann Krischke; Horst Geldmacher, both of Essen; Manfred Golomb, Bottrop; Karl-Heinz Kamp, Duisburg; Peter Masuch, Recklinghausen; Rolf Chalupnik, Essen, all of Fed. Rep. of Germany

[73] Assignee: Ruhrkohle AG, Essen, Fed. Rep. of Germany

[21] Appl. No.: 811,920

[22] Filed: Dec. 20, 1985

[30] Foreign Application Priority Data

Dec. 22, 1984 [DE] Fed. Rep. of Germany ..... 3447186

[51] Int. Cl.[4] ..... F23D 21/00; F28D 13/00; F28F 19/00

[52] U.S. Cl. ..... 431/170; 165/104.16; 165/134.1; 422/146

[58] Field of Search ..... 431/170; 122/4 D, 367 R; 165/104.16, 134.1; 422/146, 140

[56] References Cited

U.S. PATENT DOCUMENTS

| | | | |
|---|---|---|---|
| 3,030,937 | 4/1962 | Witzke | 122/6 A |
| 3,957,419 | 5/1976 | McKenzie | 431/170 |
| 4,124,068 | 11/1978 | Thompson | 165/134.1 |
| 4,425,303 | 1/1984 | Schilling et al. | 422/142 |
| 4,545,959 | 10/1985 | Schilling et al. | 422/142 |
| 4,554,967 | 11/1985 | Johnson et al. | 165/134.1 |

*Primary Examiner*—Samuel Scott
*Assistant Examiner*—Allen J. Flanigan
*Attorney, Agent, or Firm*—Nils H. Ljungman

[57] ABSTRACT

Heat exchanger tubes which are immersed in a fluidized bed of a combustion fluidized bed installation are provided with flow deflectors which reduce erosion of the fluidized materials in the bed on the tubes. The flow deflectors are preferably fins or pins, which protrude from the surface of the tubes and which disturb the erosive flow against the outer walls of the tubes. The flow deflectors also increase the surface areas of the tubes and thereby improve heat transfer from the combustion in the fluidized bed to a fluid heat exchanging medium within the tubes.

7 Claims, 5 Drawing Figures

SECTION A-A

FLUIDIZED BED HAVING MODIFIED SURFACES IN THE HEAT EXTRACTOR

BACKGROUND OF THE INVENTION

1. Field of the Invention

The invention relates generally to fluidized beds and, more particularly, to a fluidized bed with immersion heat exchangers immersed in the combustion bed thereof.

2. Description of the Prior Art

In fluidized beds, coal mixed with fine-grained sand, lime and ash particles is typically burned in a suspended state. The combustion bed is typically comprised of one or more fluidization regions or cells. The air for supporting combustion in a fluidized bed is typically introduced into the cell or cells through a nozzle or series of nozzles in the bottom of the bed. The combustion air rises through the combusting material and places the bed material in turbulent motion. Heat exchanging tubes or lines, which may produce steam or heat water, are typically immersed in the fluidized bed and transfer approximately up to fifty percent of the heat generated in the bed therefrom. By the action of this relatively high heat transfer from the bed to the heat exchanging lines, the bed temperatures are maintained at a relatively low level. Because of the turbulent motion of the combusting materials within the bed, the transfer of heat of combustion to these tubes is very great. Typically, disposed above the fluidized bed, there is a space which may be open and which is used for after-burning of the products that emanate from the fluidized bed. The exhaust gases from this open space are typically conducted into a convection heat transfer arrangement, such as in a boiler or steam generator of a conventional design well known in the art.

The combustion temperatures in fluidized beds are typically between about 800° C. to about 900° C., and preferably between 800° C. and 900° C. In this temperature range, the sulfur contained in the coal combines with limestone present in the bed. The result of this combination of limestone and sulfur is a dry, inert waste product which is primarily gypsum, which can be deposited with, and removed with, the ash produced in the bed. Typically, 80 to 90 percent of the sulfur in the coal is bound with the limestone and removed through the ash. Significantly, because of the low combustion temperatures, the $NO_x$ emissions are also significantly reduced over other means of combustion at higher temperatures. Therefore, pollution generated in fluidized bed combustion is usually significantly lower in gaseous contaminants than combustion in other types of installations. Dusts generated by the fluidized bed process are retained in a cyclone separator, typically, which is usually followed by a cloth filter. Another advantage of fluidized bed combustion is that all sorts and grades of coal, even those with a high ash content, can be burned therein without any appreciable problems.

However, a disadvantage of fluidized bed combustion resides in the relatively low output of heat in thermal units per unit of volume of the bed. This limitation of current designs is especially true for a unit which operates under atmospheric pressure conditions. Current efforts are being made to develop units having efficiencies higher than those typically presently existing in atmospheric pressure beds by applying pressurized operation to fluidized beds in so-called pressurized fluidized bed installations. Another means of increasing the efficiency is by the use of circulating fluidized beds. The pressurized fluidized bed, in contrast to the atmospheric fluidized bed, is operated at a significant pressure, greater than atmospheric pressure. In the pressurized fluidized bed, the problem of bubble formation, also encountered in atmospheric fluidized beds, is even more pronounced. These bubbles rise through the fluidized bed and interfere very substantially with the operation of the fluidized bed. These ascending bubbles, among other phenomena, produce an undesirable acceleration on the solid particles within the bed and an undesirable velocity of these particles when they leave the fluidized bed, such that the particles move beyond the after-burning zone and into the subsequent filters. This discharge of solid particles from the fluidized bed is very undesirable. In a circulating fluidized bed, the discharge of particles is promoted by the action thereby. By the filtering action, however, the recycling of unburned solid particles which have been discharged by the fluidized bed is substantially assured. Stated otherwise, the solid particles are transported in a turbulent movement in the circuit including the fluidized bed.

An example of the prior art regarding atmospheric fluidized beds is disclosed in U.S. Pat. No. 4,425,302, entitled "Fluidized Bed Reactor for Particulate Material". This U.S. patent claims priority from German Patent Publication Published for Opposition Purposes No. DE-OS 31 01 942. In this U.S. patent, the above-mentioned gas bubbles can be at least partially prevented by inserts in the form of louvers. These louvers form baffles which are comprised of sheets which stand either horizontally or are inclined downwardly to the lowest point of the combustion wall. With these louver-like baffles, the flow in the fluidized bed is deflected. Unfortunately, these baffles do not prevent the erosion of the metal outer heat exchanging immersion surfaces of the heat exchanging tubes or lines. Erosion also occurs in other types of fluidized bed installations. This erosion results from the friction of the solid particles against the preferably metal heater surfaces which are immersed in the combusting materials in the fluidized bed. Another prior art fluidized bed is disclosed in U.S. Pat. No. 4,545,959, entitled "Treatment Chamber with Fluidized Bed". Both the U.S. patents and the German Patent Publication Published for Opposition Purposes cited above are incorporated herein by reference as if set forth in full in the text of this application.

OBJECTS OF THE INVENTION

It is an object of the present invention to reduce erosion of components of fluidized bed reactors.

It is a further object of this invention to reduce erosion on heat exchangers members in fluidized bed reactors.

It is another object of the invention to improve the heat transfer of the heat generated during combustion in the fluidized bed reactor to the heat exchange members.

It is a yet further object of the invention to provide protrusions from immersion heater surfaces in the fluidized bed.

It is yet another object of the invention to provide baffles on the immersion heater surfaces which interrupt flow of the fluidized materials in the fluidized bed of the fluidized bed reactor.

It is a yet further object of the invention to provide improved heat transfer in a fluidized bed reactor.

It is another yet further object of the invention to provide fins about the circumference of the surfaces of the immersion heater.

It is a still further object of the invention to provide pins protruding from the surfaces of the immersed heat exchangers.

SUMMARY OF THE INVENTION

In order to reduce the erosion on the surfaces of the heat exchangers immersed in the fluidized beds, baffles are provided which interrupt the flow of the constituents in the bed during operation. In contrast to the known louver-like baffles which conduct the flow, the present invention provides baffles plates which impede or discourage the flow against the surfaces, which are preferably tubular, of the immersed heat exchangers. Thereby, the particle velocity at the surface of the immersion heat exchanger is significantly reduced. The intensive swirling of the combusting components in the bed impinges against the baffles of the invention. Such impingement promotes the transfer of heat to the baffles and therethrough to the surfaces of the actual, preferably tubular, heat exchanger.

The baffles preferably comprise fins or pins. In the case of the fins, these fins are distributed over the circumference of the surfaces of the immersion heat exchangers and extend in a longitudinal direction thereof. When used on tubular immersion heat exchangers, the fins may extend preferably over the entire length of the heat exchanging tube.

The fins preferably have a web width of at least 5 mm. Preferably at least 3 fins are distributed over the circumference of the preferably circular outer surfaces of the immersion type heat exchangers. In the alternate embodiment, the baffles comprise pins which act to interrupt the flow of the currents in the fluidized bed. The pins according to the invention have a length of at least 10 mm and preferably there are at least 850 pins per square meter of the corresponding tubular heat exchanger. The diameter of each pin is preferably at least 5 mm in diameter.

DESCRIPTION OF THE PREFERRED EMBODIMENTS

Figure 1:
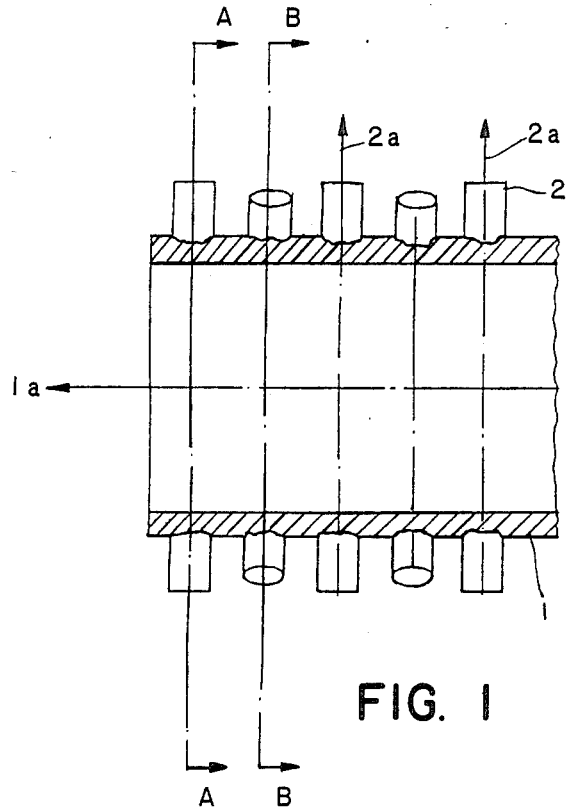
FIGS. 1 through 3 show cross sectional views of the tubes of an immersion heat exchanger having pins protruding therefrom according to one embodiment of the invention.
Figure 2:
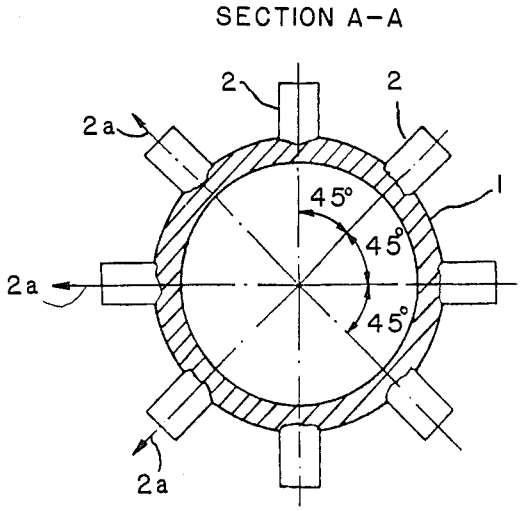
Figure 3:
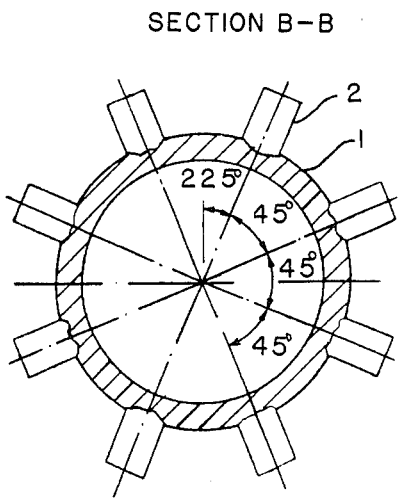

FIG. 1 schematically shows an illustration of a cooling tube 1 with pins 2 disposed on and protruding from the cooling tube 1. The cooling tube 1 shown is a portion of a heat exchanger immersed into a fluidized bed of a fluidized reactor preferably in a plant for combustion of coal. The cooling tube 1 is disposed preferably in the same manner as the cooling tubes of the two U.S. patents cited supra and incorporated herein by reference as if the entire texts thereof were set forth verbatim herein. The cooling tube 1 preferably has an outside diameter of about 57 mm and more preferably of 57 mm, and preferably a wall thickness of about 6.3 mm and more preferably of 6.3 mm. The cooling tube 1 is provided with pins 2 on and about its circumference. The pins 2 are preferably uniformly distributed over the cooling tube 1. Preferably, there are 8 pins 2, all having longitudinal axes 2*a*, and preferably disposed in a single plane octagonal to the longitudinal axis 1*a* of the cooling tube 1. FIG. 1 shows two sectional representations along lines A—A and B—B. These two sections lie in planes which are parallel to one another and are both octagonal with the longitudinal axis 1*a* of the cooling tube 1. The section A—A is disposed through centers of a first series of pins at a first location along the cooling tube 1, and the section B—B is disposed through a set of pins also through the centers. The section B—B is shown as being immediately adjacent to the set of pins of the section A—A. The pins 2 from the section A—A have their longitudinal axes 2*a* displaced angularly from the longitudinal axes 2*a* of the pins 2 of the section B—B. This angular displacement is preferably 22.5°. The pins 2 of the section A—A are preferably offset from one another at an angle of 45°, as are the pins 2 of the section B—B. The diameter of the pins 2 in the present embodiment shown in FIGS. 1, 2 and 3 is preferably about 10 mm and more preferably 10 mm, and their length, i.e., the height of the pins 2 standing from the surface of the cooling tube 1, is preferably about 15 mm and more preferably 15 mm. The arrangement of the pins 2 as shown in the FIGS. 1, 2 and 3 forms a pattern which preferably extends substantially and preferably symmetrically over the entire length and surface of the cooling tube 1 which transfers heat. The pins 2 are preferably welded to the outer surface of the cooling tube 1 by means known in the prior art.

The distance between the rows of pins and also preferably the spacing of the pins along the circumference of the cooling tube 1 along any one of the sectional planes A—A or B—B typically is preferably selected so that a serviceable weld can be executed along a seam and between the pins 2 for attachment of the pins 2 to the surface of the cooling tube 1. The spacing between the planes A—A and B—B is preferably about 18 mm. In other words, each of the circumferential rows is spaced 18 mm from its immediately adjacent rows. The spacing between rows having the same angular orientation of pins 2 is preferably about 36 mm.

As a result of the arrangement of the pins 2 described above which are disposed on the external surface of the cooling tube 1, the marginal flow of the fluidized materials in the fluidized bed during operation are guided so that the principal mechanical erosional forces are preferably exerted on the pins 2 and preferably kept away from the surface of the cooling tube 1 to a degree. Also, the pins 2 increase the outer surface of the cooling tube 1 thereby facilitating and preferably improving the heat conduction from the fluidized bed during combustion into the interior of the cooling tube 1, thereby improving the efficiency thereof.

Figure 4:
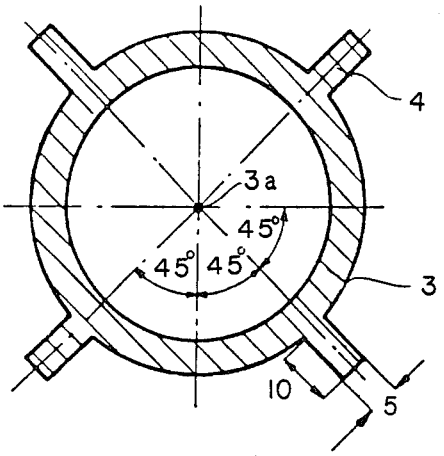
FIGS. 4 and 5 show cross sectional views of cooling tubes of an immersion heat exchanger having fins disposed thereon, thereby forming fin tubes according to an alternative embodiment of the invention.

FIG. 4 shows a sectional view of an alternative embodiment of the invention. In FIG. 4, a cooling tube 3 is shown which has preferably substantially the same dimensions as the cooling tube 1 shown in FIGS. 1, 2 and 3. The cooling tube 3 has fins 4 which are disposed along the external surface of the cooling tube 3 and preferably substantially parallel with a longitudinal axis 3*a* of the cooling tube 3. The fins 4, which extend along the cooling tube 3 preferably along a genetrix of a cylinder defining the cooling tube 3, are distributed over the circumference of the outer surface of the cooling tube 3 at an angle of 45° to the vertical, as shown in FIG. 4. The offset between one fin 4 and the next is preferably 90°. When the cooling tube 3 is disposed in the fluidized bed during operation, the flow of fluidized materials within the bed preferably moves from the bottom of the figure of the cooling tube as shown in FIG. 4 to the top of the figure as shown therein. By a flow as described coming from below, this flow is deflected so that the principal mechanical stresses and erosions caused by the flow of the contents within the fluidized bed are exerted on the fins 4 and to some degree are kept a distance from the outer surface of the cooling tube 3, or are reduced in velocity when impinging upon the outer surface of the cooling tube 3. The fins 4 are preferably about 5 mm wide and more preferably 5 mm wide, and preferably about 10 mm high and more preferably 10 mm high, and preferably least 5 mm high. As shown in FIG. 4, the fins are preferably distributed evenly about the circumference of the cooling tube 3.

Figure 5:
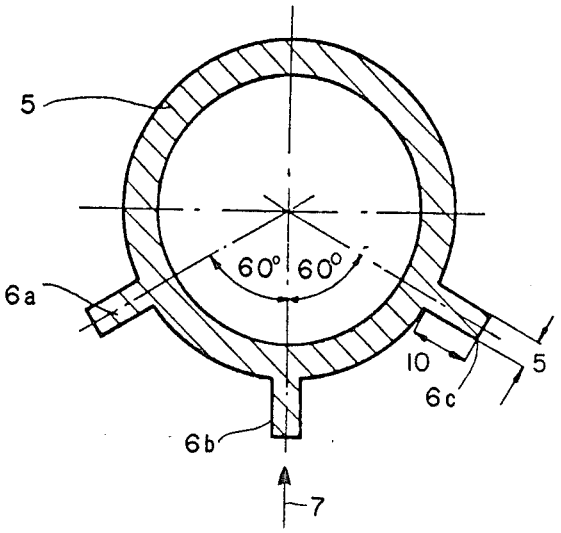

FIG. 5 shows a further alternative embodiment of the invention in section. This figure shows a cooling tube 5 which preferably has the same dimensions as the cooling tube 1 of FIGS. 1, 2 and 3 and the cooling tube 3 of FIG. 4. This cooling tube 5 preferably has, as shown, three fins 6*a*, 6*b* and 6*c*. The fins 6*a*, 6*b* and 6*c*, however, are preferably on a portion of the circumference of a cooling tube 5 which faces the flow of the particles within the fluidized bed which direction of flow is shown by the arrow designated by the number 7. The lowest fin 6*b* of the three fins 6*a*, 6*b* and 6*c* is located at the bottom of the cooling tube 5 and has its most extreme surface, its end surface, disposed substantially perpendicular to and impinged directly by the flow, as indicated by the arrow 7. Therefore, in operation, the lowest fin 6*b* has its extreme end surface disposed as an impact point pointing toward the head of the arrow 7 which indicates the flow of particles within the fluidized bed. The other two fins 6*a* and 6*c* are located preferably left and right of the lowest fin 6*b*, and are disposed angularly from the fin 6*b* at an angular measure of preferably about 60°. The direction of flow of all the embodiments shown in the FIGS. 1 through 5 is preferably from the bottom of the Figures as disposed in the drawings. Again, in FIGS. 4 and 5, the fins are preferably either welded, or unlike FIGS. 1 through 3, FIGS. 4 and 5 may alternatively be cast with the cooling tubes 3 and 5 of the invention.

Additionally, in the embodiment as illustrated in FIG. 5, there is an additional deflection of particle flow from the surface of the tube which protects the fin surface of the outer diameter of the tube proper from erosion. Also, there may be other effects which the deflection elements in the invention comprising preferably pins and fins which improve the operation of the heat transfer of the tubes.

Furthermore, the pins and fins which are preferably welded onto the cooling tubes 1, 3 and 5 also advantageously increase the area of the surface which makes contact with the particulates and participants of the heat exchange and thereby improve such heat exchange between the combusting materials and the interior fluid within the cooling tubes. Therefore, the number of immersion tubes may be reduced in a particular fluidized bed made according to the instant invention, thereby reducing the cost of the bed and possibly even improving the efficiency thereof, since a greater portion of the volume of the bed may be dedicated to combustion rather than heat transfer.

The immersion heat exchange surfaces and tubes according to the present invention are not only suitable for atmospheric fluidized beds, but also for circulating and pressurized fluidized bed combustion installations thereof.

The invention as described hereinabove in the context of the preferred embodiments is not to be taken as limited to all of the provided details thereof, since modifications and variations thereof may be made without departing from the spirit and scope of the invention.

What is claimed is:

1. A fluidized combustion bed having immersion heat exchanger tubular means, said tubular means having an inner surface and an outer surface;
   said tubular means comprising a plurality of tubes spaced away from one another;
   said bed having inlet means and outlet means for the flow of fluid therebetween;
   said tubes being disposed substantially transverse to the flow in said bed;
   said inner surface of said tubular means defining means for conducting a heat transferring medium through said tubular means;
   said outer surface of said tubular means having protrusions extending therefrom;
   said protrusions being disposed to deflect, at least partially, a flow of products of combustion in said fluidized bed from said outer surface; and
   said protrusions being pins disposed on and protruding from said outer surface and distributed thereover, whereby erosion of said outer surface of said tubular means is minimized, said pins being disposed on said outer surface of said tubular means in encircling, circumferential rows of spaced pins, adjacent circumferential rows being angularly displaced from one another about the longitudinal axis of said tubular means.

2. A heat exchanger according to claim 1, wherein the diameter of said outer surface of said tubular means is about 57 mm, wherein the diameter of said inner surface of said tubular means is about 44.4 mm, wherein the height of said protruding pins is about 15 mm beyond said outer surface, and wherein said pins have a diameter of about 10 mm.

3. A heat exchanger according to claim 2, wherein said adjacent circumferential rows of said pins are spaced about 18 mm from one another along the longitudinal axis of said tubular means.

4. A fluidized combustion bed having immersion heat exchanger tubular means, said tubular means having an inner surface, an outer surface, a top and a bottom;
   said tubular means comprising a plurality of tubes spaced away from one another;
   said bed having inlet means and outlet means for the flow of fluid therebetween;
   said tubes being disposed substantially transverse to the flow in said bed;
   said inner surface of said tubular means defining means for conducting a heat transferring medium through said tubular means;
   said outer surface of said tubular means having protrusions extending therefrom;
   said protrusions being disposed to deflect, at least partially, a flow of products of combustion in said fluidized bed from said outer surface;
   said protrusions comprising fins disposed on and protruding from said outer surface and said fins being disposed solely on the upstream surface, with respect to the flow, of said tubular means;
   said tubular means having a longitudinal axis; and said fins being disposed to extend along said longitudinal axis of said tubular means.

5. A heat exchanger according to claim 3, wherein there are provided at least 850 pins per square meter of said outer surface of said tubular means.

6. A heat exchanger according to claim 4, wherein the diameter of said outer surface of said tubular means is about 57 mm, wherein the diameter of said inner surface of said tubular means is about 44.4 mm, wherein the width of each of said fins is about 5 mm, and wherein each of said fins protrudes beyond said outer surface of said tubular means by about 10 mm.

7. A heat exchanger according to claim 4, wherein the diameter of said outer surface of said tubular means is about 57 mm, wherein the diameter of said inner surface of said tubular means is about 44.4 mm, wherein the width of each of said fins is about 5 mm, and wherein each of said fins protrudes beyond said outer surface of said tubular means by about 10 mm.

* * * * *